US005135273A

United States Patent [19]

MacCalder

[11] Patent Number: 5,135,273

[45] Date of Patent: Aug. 4, 1992

[54] DOOR SECURITY SYSTEM

[76] Inventor: John H. MacCalder, 6620 Dalcroft Hill NW., Calgary, Alberta, Canada, T3A 1N4

[21] Appl. No.: 701,887

[22] Filed: May 17, 1991

[51] Int. Cl.[5] ..... E05C 17/16

[52] U.S. Cl. ..... 292/338; 292/DIG. 15; 292/DIG. 60

[58] Field of Search ..... 292/338, 339, 258, DIG. 15, 292/DIG. 60

[56] References Cited

U.S. PATENT DOCUMENTS

| | | | |
|---|---|---|---|
| D. 290,579 | 6/1987 | Crisp et al. | D8/339 |
| 1,032,585 | 7/1912 | Brady | 292/339 |
| 1,044,728 | 11/1912 | Basler | 292/338 |
| 1,064,320 | 6/1913 | Glindkamp . | |
| 1,820,486 | 8/1931 | Patrick et al. . | |
| 1,847,705 | 3/1932 | Yorger . | |
| 1,985,164 | 12/1934 | Green | 292/338 |
| 2,595,709 | 5/1952 | Sands | 292/339 |
| 3,731,341 | 5/1973 | Woodruff | 16/82 |
| 4,456,291 | 6/1984 | Brogie | 292/338 |
| 4,456,921 | 6/1984 | Brogie | 292/338 |
| 4,514,000 | 4/1985 | Chezem et al. | 292/338 |
| 4,560,192 | 12/1985 | Wilson et al. | 292/339 |
| 4,607,870 | 8/1986 | Crisp et al. | 292/338 |
| 4,641,869 | 2/1987 | Johnson | 292/339 |
| 4,673,203 | 6/1987 | Chezem | 292/338 X |
| 4,822,086 | 4/1989 | Brown | 292/338 |

*Primary Examiner*—Richard E. Moore
*Attorney, Agent, or Firm*—Robert W. B. Bailey

[57] ABSTRACT

A door security system has a floor contacting foot pivoted on a prop itself pivoted on a locking system adjustably attached to a door support removably mountable on a door by a detachable bracket. The system is simple to install. A door so equipped can be opened a slit for conversation but insufficient for entry, then locked in position. The bracket has opposed spaced apart face walls joined by edge wall to receive a door corner, the door support is attachable to the bracket by a wingnut. The hand releasable locking system has saw teeth engaging saw teeth on the door support. Prop mountings on both foot and locking system restrict the angle of the prop to the floor. This angle may be from 60 to 70, and conveniently is 65. The device may be installed permanently or temporarily, on a door, it is far more effective than a door chain. Both bracket and door support can be permanently fastened to the door by screws.

21 Claims, 4 Drawing Sheets

DOOR SECURITY SYSTEM

This invention relates to door security systems. In particular it relates to door security system kits which fit on lower corners of doors, especially inner doors.

Although the invention will be described and referred to specifically as it relates to door security system kits including bracket means, support means, prop means, locking system means, foot means, it will be understood that the principles of this invention are equally applicable to similar devices and accordingly, it will be understood that the invention is not limited to such door security system kits.

DESCRIPTION OF PRIOR ART

U.S. Pat. No. 1,064,320, issued Jun. 10, 1913, to Glindkamp, teaches a temporary door securer having an L shaped member with a upper section fitting against the inside of the door, while the lower section fits against the bottom of the door, engaging the door bottom by barbs. An adjustable extendible prop is hinged to the top of the upper vertical section of the L.

U.S. Pat. No. 1,820,486, issued Aug. 25, 1931, to Patrick, teaches a permanent door securer having a vertical section fixed by screws to the door. A prop pivotally mounted in slots in the vertical section is movable between a lower floor engaging position and an upper disengaged position. This prop may have a rubber floor engaging tip.

U.S. Pat. No. 1,847,705 issued Mar. 1, 1932, to Yorger, teaches a permanent door securer having a vertical channel member including a slider, fixed by screws to the door. A prop, pivotally mounted at the lower end of the slider, has a floor engaging point. The slider engages the channel in a lower floor engaging position and an upper disengaged position.

U.S. Pat. No. 3,731,341, issued May 9, 1973, to Woodruff teaches a temporary door securer having an L shaped member of which the vertical section fits against the door, while the lower section fits against the bottom of the door, engaging the door bottom by barbs. A prop is hinged to the top of the vertical section, while a link is pivotally mounted on the vertical section. The link terminates in a latch, engaging notches in the prop in different selected positions to give different prop-door angles. The door engaging surface of the L shaped portion may be nonabrasive material. The floor engaging end of the prop may be slide-resistant material.

U.S. Pat. No. 4,456,291 issued Jun. 26, 1984, to Brogie, teaches a permanent door securer having a vertical channel section fixed to the door. In one form a prop is pivotally mounted in the upper end of the channel. This prop is telescopically extendible from a retracted short length to an extended floor engaging length. In the other form the prop, pivoted on a pin slidably mounted in the channel, is movable between a lower floor engaging position and an upper disengaged position. Both props have a pivoted floor engaging foot.

U.S. Pat. No. 4,514,000 issued Apr. 30, 1985, to Chezem et al., teaches several door securers having a vertical channel member, pivotally mounting a prop, which is biased outward by a spring, a tension member between prop and section sliding in slots in both holds the prop in position. When the door is forced slightly, the tension member drops to hold the prop in place in the new position. The prop may have a non slip floor contacting surface or end in a resilient pad. The vertical section may be fixed to the door permanently by screws, or temporarily by a U shaped base fitting the door bottom, or temporarily by an L shaped base and hanging from a door knob.

In related U.S. Pat. No. 4,673,203, issued Jun. 16, 1987, to Chezem, the tension member is improved by pivotally mounting it on a counterweight sliding within the vertical channel member, and having a frictional padded head to engage the prop.

U.S. Pat. No. 4,560,192 issued Dec. 24, 1985, to Wilson et al., teaches a temporary door securer having a U shaped door edge fitting section removably securable thereto by a threaded rod and plate passing through an arm of the U. Pivotally mounted on the external end of the rod is a prop having a pivoted floor engaging foot, preferably the prop includes a turnbuckle allowing length adjustment.

U.S. Pat. No. 4,607,870 issued Aug. 26, 1986, and U.S. Pat. No. 290,579, issued Jun. 30, 1987, both to Crisp, Jr. et al., teaches a permanent door securer having a vertical channel section fixed to the door. A prop is pivotally mounted on a pin slidably mounted in the channel, allows the prop to move between a lower floor engaging position and an upper disengaged position. In the earlier filed design patent, the disengaged prop engages a hooked door plate. In the later filed patent, a control rod pivotally fixed to the door and slidably fixed to the prop, and a tension spring attached to prop and door urge them together. Both props have a pivoted floor engaging foot, including a tension spring urging the foot into floor contact.

U.S. Pat. No. 4,641,869 issued Feb. 10, 1987, to Johnson, teaches a removable permanent door securer having a prop with a pivoted floor engaging foot, and a conical head adapted to engage a recessed support member attached to the door by screws and angled anchors.

U.S. Pat. No. 4,822,086 issued Apr. 18, 1989 to Brown, teaches a permanent door securer having an extendible prop with a pivoted floor engaging foot, pivotally mounted within a recessed support member, bias springs urge the prop towards the door.

It is an object of the invention to provide an improved door security system kit. Other objects will be apparent to those skilled in the art from the following specification, appended claims and accompanying drawings.

DESCRIPTION OF THE INVENTION

The invention in broad aspect is directed to an improved security system kit for mounting to the inner face of a door to engage the floor to prevent the door being opened comprising in combination: bracket means, support means mountable on the door by the bracket means, prop means pivotally mounted in the support means by locking system means, and floor contacting foot means pivotally mounted on the prop means. The improvement provides the bracket means having opposed spaced apart parallel inner and outer face walls, spaced a distance apart parallel inner and outer face walls, spaced a distance apart, so as to receive contactingly a door therebetween. Edge walls connect the opposed face walls. The edge walls being at right angles to each other and to the face walls, so the edge walls may contact adjacent edges of a door. The inner face wall having attachment means mounted thereon to mount the support means thereon. The edge walls extend toward each other at least about ¼ inch past an imaginary plane at right angles to each the edge wall and passing through the center of the attachment means.

In one broad aspect the invention is directed to an improved security system kit for mounting to the inner face of a door to engage the floor to prevent the door being opened comprising in combination: bracket means, support means mountable on the door by the bracket means, prop means pivotally mounted in the support means by locking system means, and floor contacting foot means pivotally mounted on the prop means. The improvement provides the bracket means having opposed spaced apart parallel inner and outer face walls. The face walls are spaced a distance apart, so as to receive contactingly a door therebetween. Edge walls connect the opposed face walls, the edge walls being at right angles to each other and to the face walls, so the edge walls may contact adjacent edges of a door. The inner face wall has threaded stud means protruding perpendicularly therefrom to mount the support means thereon. The edge walls extend toward each other at least about ¼ inch past an imaginary plane at right angles to each edge wall and passing through the center of the threaded stud means. Preferably the edge walls extend toward each other at least ⅜ inch past the imaginary planes. The inner face wall may have four circular apertures equidistant the threaded stud means, each aperture being centered on an imaginary line passing through the center of the threaded stud means and at right angles to one edge wall. The stud means is preferably is central of the inner face wall.

In another broad aspect the invention is directed to security system kit for mounting to the inner face of a door to engage the floor to prevent the door being opened comprising in combination: bracket means, support means mountable on the door by the bracket means, prop means pivotally mounted in the support means by locking system means, and floor contacting foot means pivotally mounted on the prop means. The improvement provides the support means comprising base wall means for mounting to the inner face of a door, and the support means includes channel means extending upward from attachment means to the bracket means when the base wall means is mounted on a door. The channel means including paired spaced apart opposed channel walls having facing longitudinally extending grooves therein. The locking system means comprising slide means slidably mounted in the channels means, the slide means having side flanges slidably received in the grooves, the slide means mounting releasable locking means. The channel means further including receiving means for mating engagement of the locking means, extending longitudinally of the channel means. The locking means may be provided by each channel means wall having saw tooth surfaces extending longitudinally of said walls, facing away from said door when said support means is mounted thereon. A well means within the slide means has opposed inner and outer walls, the outer wall having an aperture, shaft means slidably mounted in the aperture, block means having saw tooth surface means mounted on the shaft means, spring means in the well means in contact with the block means and the outer wall urging the saw tooth surface means into mating engagement with the saw tooth surfaces of the channel walls. Handle means attached to the shaft means, enable disengagement of the block means. Alternatively the channel means has a longitudinal array of equidistant apertures in the base wall means. A well means within the slide means has opposed inner and outer walls, the outer wall having an aperture, shaft means slidably mounted in the aperture, block means having prongs slidably received in apertures in the inner wall, spring means in the well means in contact with the block means and the outer wall urging the prongs through the inner wall to be received matingly in the array of equidistant apertures. Again handle means attached to the shaft means, enables disengagement of the prongs from the array of apertures.

The base wall means can include first lower base aperture means to receive the threaded stud means of the bracket means allowing the base wall means to be bolted to the bracket means. The base wall means may have two larger circular lower apertures equidistant from the first lower base aperture means. These larger apertures are aligned above and below the first lower base aperture means when the base wall means is mounted on the door, the larger base apertures contain alignment plugs which protrude matingly into two opposed bracket inner face wall apertures. These larger base apertures may be provided by wells on the door side of the base wall means.

In a further broad aspect the invention is directed to an improved security system kit for mounting to the inner face of a door to engage the floor to prevent the door being opened comprising in combination: bracket means, support means mountable on the door by the bracket means adapted to engage inner and outer faces of the door, prop means pivotally mounted in the support means by locking system means the locking system means being slidably mounted in the support means, and floor contacting foot means pivotally mounted on the prop means. The improvement providing the prop means having a lower end pivotally mounting foot means, the foot means having floor contacting base means and paired opposed side walls, the foot means being pivotable between an upper position aligned with the prop means and a lower angled position from about 110° to about 120°, preferably about 115°, downward and outward of the upper position. The prop lower end has a surface engaging a surface of the base means in the lower angled position and preventing further outward and downward rotation. The base means may have a floor contacting surface of frictional material. The locking system means can have pivot means, to pivotally mount prop means at an upper end, the upper end being pivotable between a first upper position angled from about 20° to about 30°, preferably about 25°, outward and downward of the support means and a second positon adjacent the support means, said locking system having a surface which engages a surface of the upper end of the prop in the first position preventing further upward and outward rotation.

In use the bracket is attached to the door, the support to the bracket, the prop is pulled out, the locking system disengaged and it and the prop slid down until the foot engages the floor.

BRIEF DESCRIPTION OF THE DRAWINGS

Preferred embodiments are indicated in the drawings where.

DESCRIPTION OF THE PREFERRED EMBODIMENTS

The general description of the invention is now expanded by reference to the drawings, which illustrate preferred embodiments of the invention.

Figure 1:
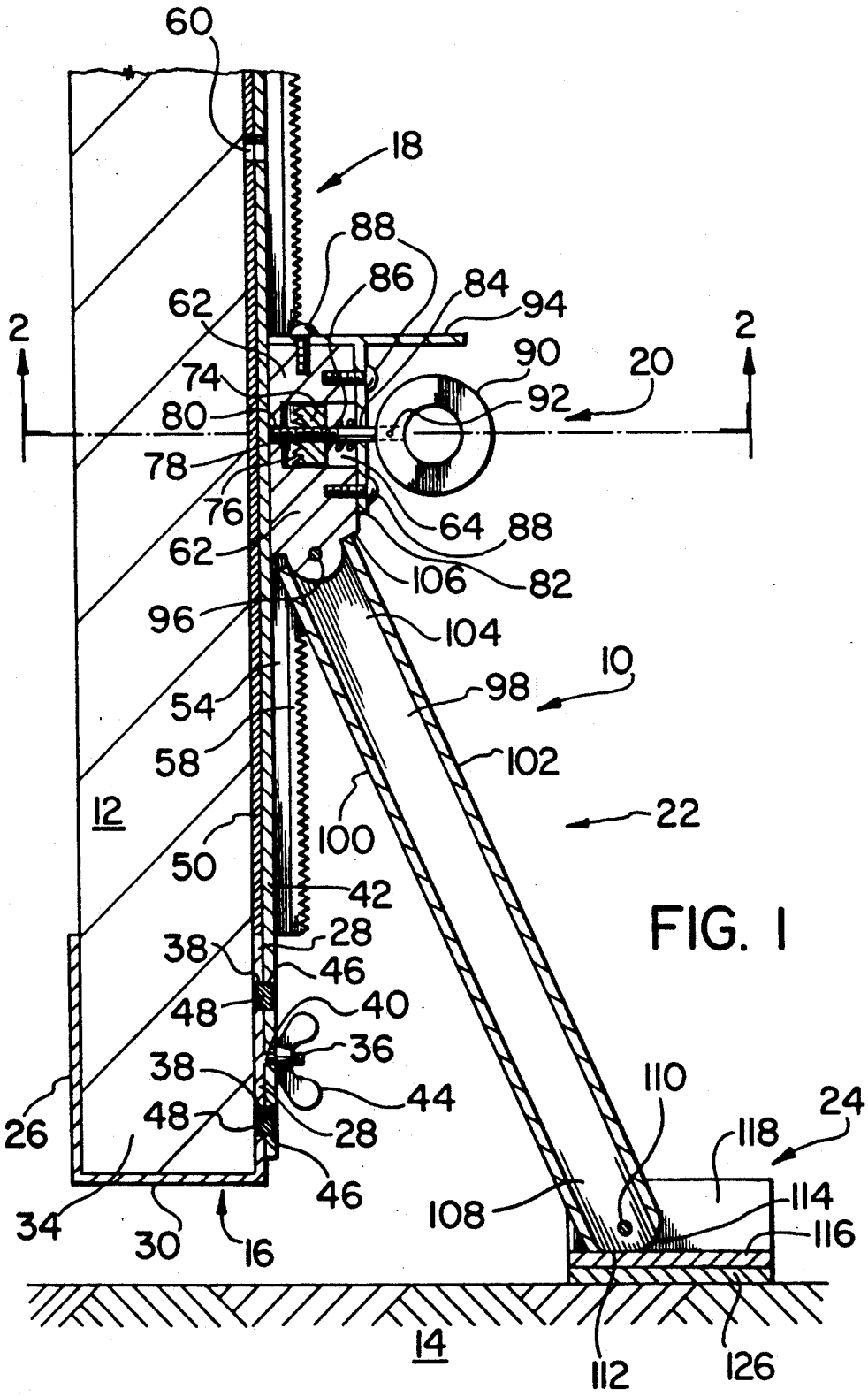
FIG. 1 shows a side sectional view of an embodiment of the invention as attached to a door.
Figure 2:
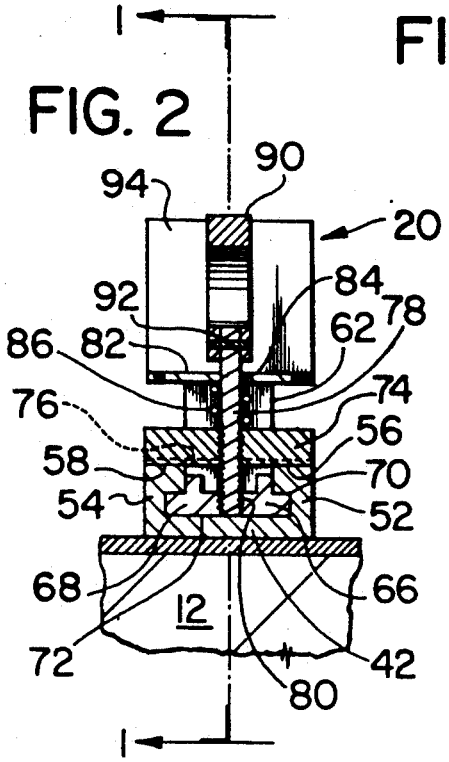
FIG. 2 shows a plan sectional view of the locking system of FIG. 1 as attached to a door.
Figure 3:
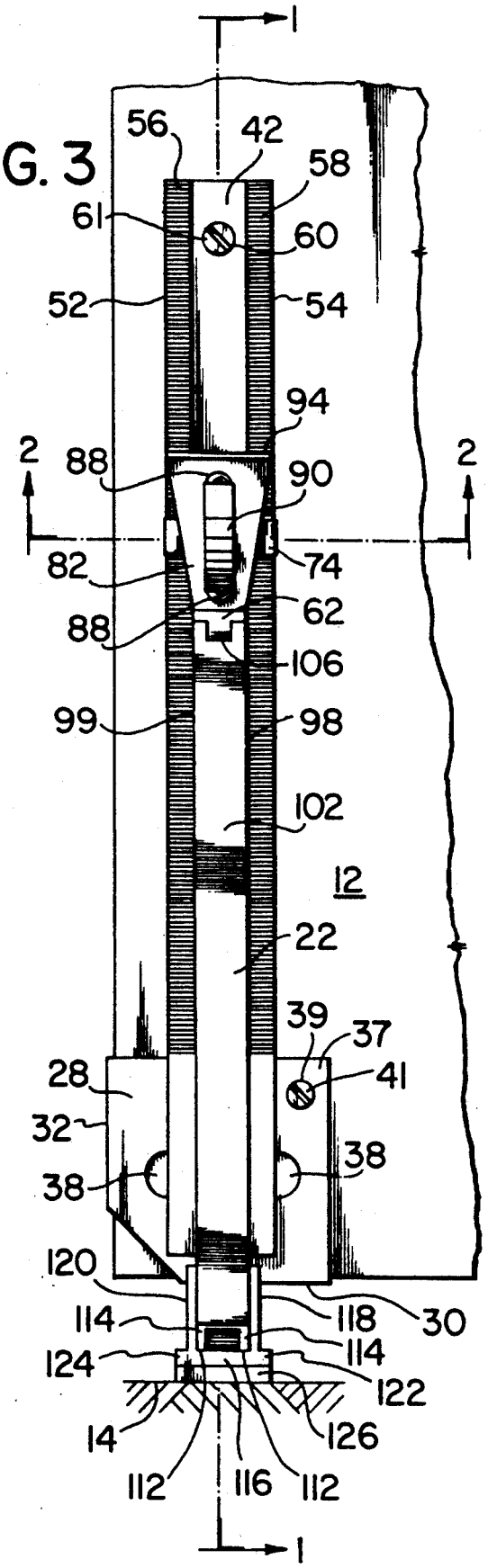
FIG. 3 shows an elevational view of the embodiment of FIG. 1 as attached to a door.
Figure 4:
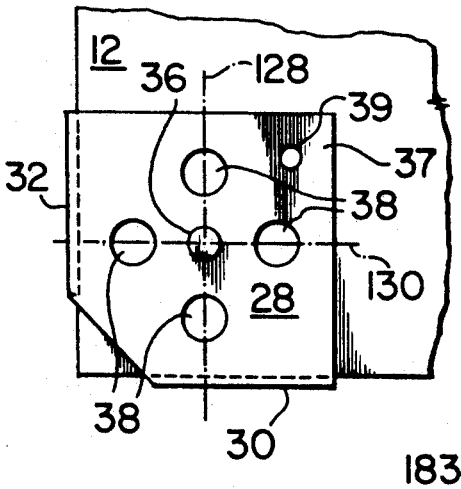
FIG. 4 shows a part sectional view of an embodiment of a bracket of the invention.
Figure 5:
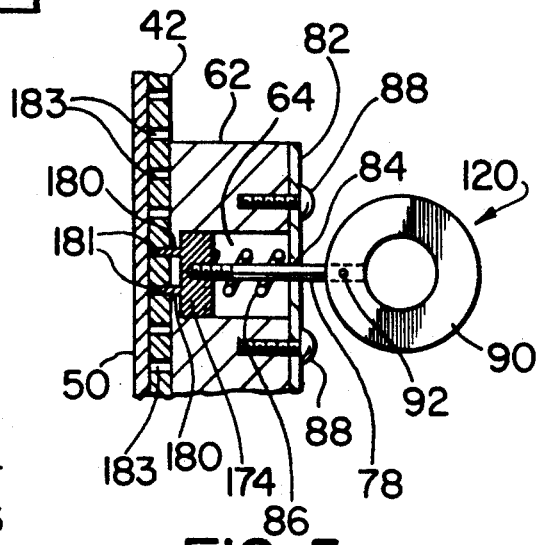
FIG. 5 shows a side sectional view of an alternative embodiment of the locking system to that of FIG. 1.
Figure 6:
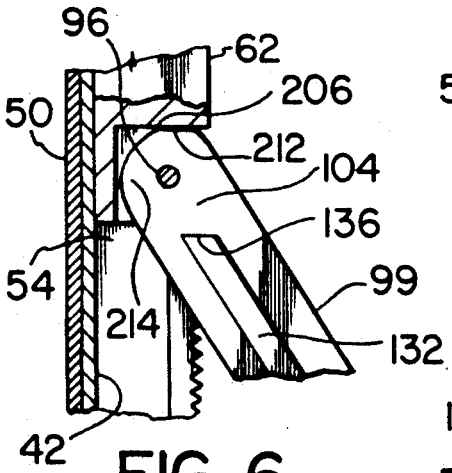
FIG. 6 shows a side part sectional view of an alternative embodiment of prop pivot mounting to that of FIG. 1.
Figure 7:
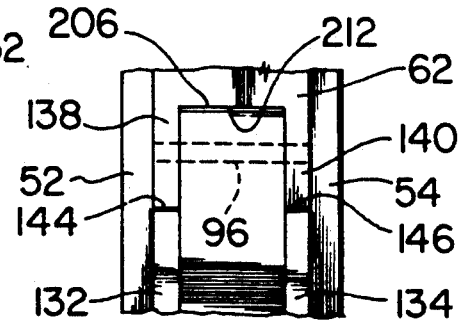
FIG. 7 shows a rear view of the embodiment of FIG. 6.
Figure 8:
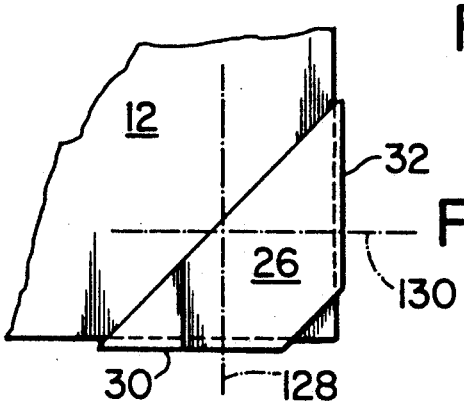
FIG. 8 shows a part sectional view of an embodiment of a bracket of the invention as attached to the outside of a door.

Numeral 10 generally indicates the door security system of the invention, this system is attached to door 12 and rests on floor 14. System 10 has door attachment bracket 16, door support 18, locking system 20, prop 22 and foot 24. Bracket 16 includes outer face wall 26, inner face wall 28 and edge walls 30 and 32, forming space 34 into which door 12 fits snugly. Space 34 between face walls 26 and 28 is of a size to snugly receive door 12, typically space 34 is 1¾ inch or 1⅛ inch, but as those skilled in the art would appreciate brackets can be made for any required door thickness. Bracket 16 may conveniently be sheet metal or plastic of suitable engineering strengths. Inner face wall 28 has central threaded stud 36 surrounded by four circular holes 38, two vertically aligned with stud 36 and two horizontally aligned with stud 36. Inner face wall 26 is a modified square. Optionally inner corner 37 may provide hole 39 allowing attachment to the door by attachment means for instance screw 41. Outer face wall 28 is of trapezoid form extending between edge walls 30 and 32, which themselves are rectangular, in use they abut adjoining door edges. Door support 18 is secured to bracket 18 and door 12 by wingnut 44 threaded onto stud 36 which passes through hole 40 in door wall 42 of door support 18. Applicant has found (shown in FIGS. 4 and 8) that edge walls 30 and 32 must extend toward the corner of the door, well past center lines 128 and 130 passing through stud 36. When pressure is exerted on door 12 and security system 10, and for instance, edge wall 30 does not extend past line 128, bracket 16 tends to slip down off the door. In an original version (not shown) edge wall 30 did not extend to center line 128, it was found necessary to extend edge wall 30 past center line 128, generally ¼ inch or more preferably ⅜ inch extension was found satisfactory. The same extension is necessary on edge wall 32, so as to allow bracket 16 to be used on both right and lefthand lower door corners, this extension is easily routinely determinable by those skilled in the art. Door wall 42 has paired vertical holes 46 which align with vertical holes 38, alignment plugs 48 fixed within holes 46 protrude into holes 34. Above inner face wall 28, door wall 42 has resilient covering 50, to protect the surface of the door, channel walls 52 and 54 extend outward from door wall 42 with sawtooth outer surfaces 56 and 58, sawtooth surfaces of 3/32 inch spacing and 1/16 inch depth, and 1/20 inch spacing and 1/20 inch depth have been successfully utilized, as those skilled in the art would realize these parameters can be routinely varied. Hole 60 at the top end of door wall 42 allows for permanent attachment of door support 18 to door 12, by suitable attachment means, for instance screw 61. Locking system 20 includes housing 62, which has central well 64, and side flanges 66 and 68, which slidably engage grooves 70 and 72 in channel walls 52 and 54. Grooves 70 and 72 and extend the length of channel walls 52 and 54. Locking system 20 is locked in place by block 74, which matingly engages sawtooth surfaces 56 and 58 of door support 18, by its own sawtooth surface 76. Block 74 is threaded diameter shaft 78, which is slidably received in hole 80 in housing 62, shaft 78 is horizontally aligned in well 64 by plate 82 in which it is slidably received by hole 84, bias spring 86 urges block 74 into mating engagement with sawtooth surfaces 56 and 58. Plate 82, is secured to housing 62 by screws 88. Handle 90, which is secured to shaft 78 by pin 92 allows the operator to pull shaft 78 away from the door releasing block 74 from mating engagement and allowing locking system 20 to be slid up or down in door support 18. Step or plate 94, preferably integral with plate 82, which is similarly secured to housing 62, by screw 88, provides a surface to allow the operator to exert upward or downward pressure on locking system 20. Alternative locking system 120 has a similar arrangement (FIG. 5), in which shaft 78 is threadably received in block 174. Prongs 181 of block 174 engage array of paired holes 183 in door wall 42, through holes 180 in housing 62. Pulling handle 90 allows block 174 and prongs 181 to be raised disengaging prongs 181 from hole array 183 allowing movement of locking system 120 up or down. Prop 22 is pivotally mounted in housing 62 by pivot pin 96, and consists of a modified rectangular tube, with side walls 98 and 99, and front wall 100 and rear wall 102. When locking system 20 is pushed down prop 22 rotates until upper end 104 of rear wall 102 contacts surface 106 of housing 62, which may be at any desired angle to the horizontal. Prop 22 is at the same angle to the vertical. In practice this angle is desirably between about 20° and about 30°, preferably about 25°. At lesser angles prop 12 tends to fold against door 12 as it is raised by external pressure. At greater angles the frictional resistance developed by foot 24 may be insufficient to prevent movement of door 12, certainly at a angle of 35° to the vertical or 55° to the horizontal the foot has a tendency to slip. An alternative prop pivot mounting (FIGS. 6 and 7) has walls 98 and 99 of prop end 104 having flat end segment 212 adjoining arcuate end segment 214, at the desired angle segment 212 meets horizontal surface 206 of housing 62. Prop 22 has optional side ribs 132, 134 terminating in flat surfaces 136 and 138, parallel to flat end segment 212. At the desired angle surfaces 136 and 138, meet side walls 140 and 142 of housing 62, in which is mounted pivot pin 96 (shown in ghost), along surfaces 144 and 146. Lower end 108 of prop 22 is pivotally mounted in foot 24 by pin 110. Walls 98 and 99 of end 108 have a specific shape flat segment 112 adjoining arcuate segment 114. Flat segment 112 is desirably at an angle of about 60° to about 70° to wall 100, and preferably about 65°. Flat segment 112 contacts base 116 of foot 24. Foot 24, has sidewalls 118 and 120, base 116 has flanges 122 and 124, and has frictional base layer 126 to engage floor 14.

Figure 9:
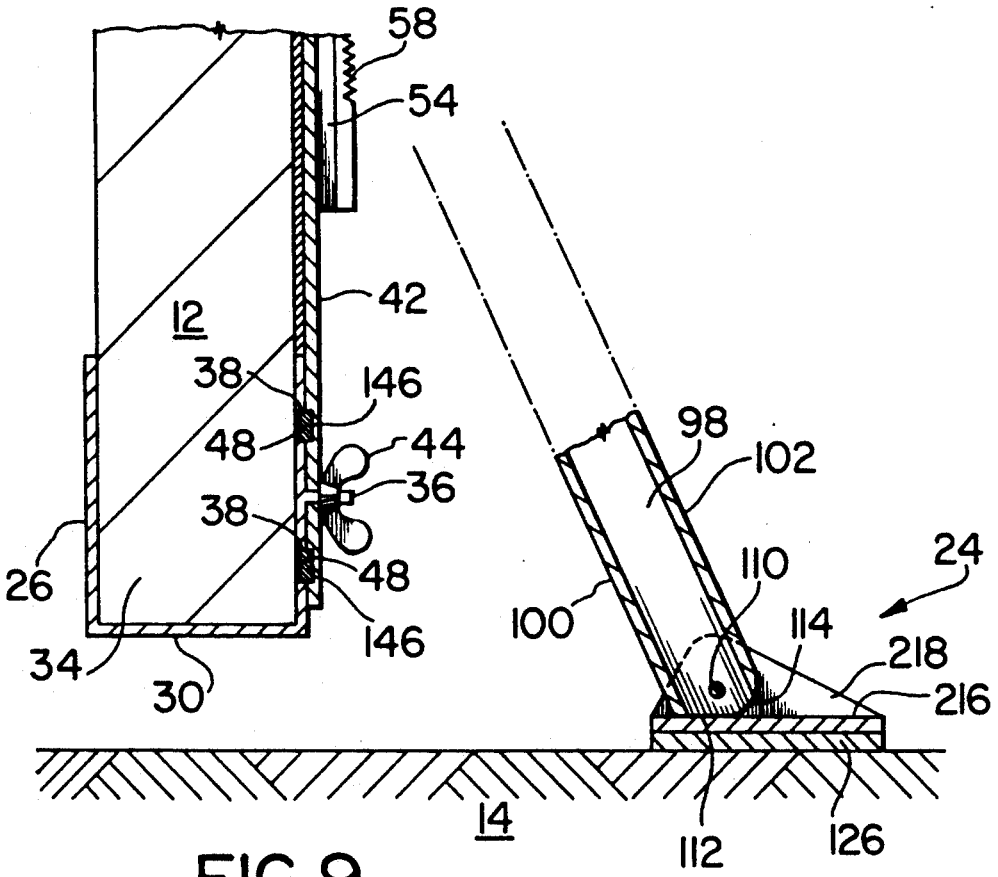
FIG. 9 shows a side sectional view of another embodiment of the lower door support and foot of the invention as attached to a door.
Figure 10:
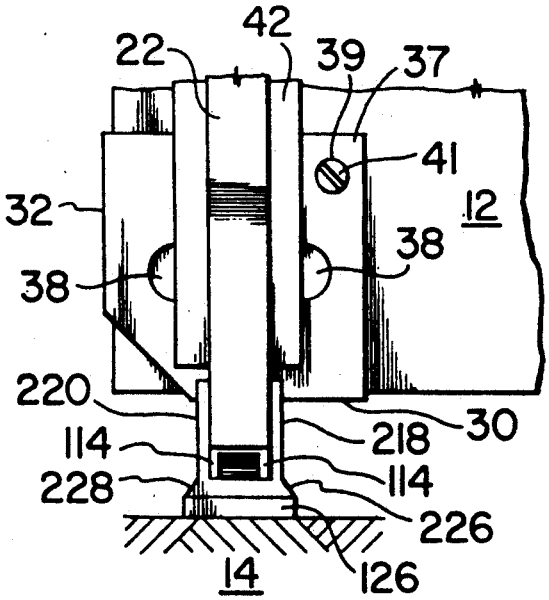
FIG. 10 shows a part elevational view of the embodiment of FIG. 9 as attached to a door.

Alternative embodiments (FIGS. 9 and 10), shown wells 146 in door wall 42 containing plugs 48 engaging bracket apertures 38, with channel wall 54 starting further up door wall 42, and sawtooth surface 58 starting further up channel wall 54, door wall 42 lacks a resilient covering. Foot 224 has rounded triangular walls 218 and 220 and angled flanges 226 and 228, which allows objects slid through any gap will has less tendency to go underneath foot 224.

The dimensions used in the device are indicated as an illustrative guide and not as limitations. The door bracket has an inner face wall approximately 2 inches square. The door support is about 9½ inches long 1 inch across with the channel extending 5¾ to 7½ inches, and sawtooth surfaces extending 4½ to 7½ inches along the channel. The channel walls are 7/16 inch deep, with the channel itself being ½ inch wide and 5/16 inch deep, and having grooves ⅛ inch by ⅛ inch. The lock system housing fits slidably into the channel, and is about 2 inches long, with a central well approximately ½ inch square. The prop is 7 inches long, ¾ inch deep and ½ inch wide, it may be solid, but is preferably hollow with ⅛ inch thick walls. The foot is 1¾ inch long, and 1 inch wide, ⅞ inch deep with rectangular sidewalls or ¾ inch deep with triangular sidewalls. The foot walls are ⅛ inch thick.

In use the operator fits bracket 16 onto the corner of the door. Rest of the system 10 is then attached by wingnut 44, and locking system 20 slid down, by pulling block 74 away from surfaces 56 and 58 using handle 92, and exerting pressure on step 94, prop 22 is swung out until wall 102 contacts surface 106 at the desired angle and foot 24 engages floor 14, with surface 112 contacting floor wall 116, at this point operator releases the handle and block 74 matingly engages surfaces 56 and 58. If the operator wishes to open the door handle 92 is used to disengage block 74, locking system 20 (with prop 22 and foot 24) is raised slightly, allowing the door to be opened. The door may be opened a slit and locking system 20 moved down for foot 24 to engage floor 14. Applicant has found device 10 extremely effective, force exerted against the door raises it into the lintel, without significant displacement of foot 24 or 224.

By way of illustration but not of limitation, the bracket is conveniently made from sheet metal, while the rest of the kit is generally made from aluminum. Those skilled in the art can routinely determine suitable materials to use in the device, which as indicated include plastics of suitable engineering strengths.

As those skilled in the art would realize these preferred illustrated dimensions, details and components can be subjected to substantial variation, modification, change, alteration, and substitution without affecting or modifying the function of the illustrated embodiments.

This invention is not limited to the embodiments described above, and it will be apparent to persons skilled in the art that numerous modifications and variations form part of the present invention insofar as they do not depart from the spirit, nature and scope of the claimed and described invention.

I claim:

1. In a security system kit for mounting to the inner face of a door to engage the floor to prevent the door being opened comprising in combination:

bracket means, support means mountable on said door by said bracket means, prop means pivotally mounted in said support means by locking system means, and floor contacting foot means pivotally mounted on said prop means, the improvement comprising said bracket means having opposed spaced apart parallel inner and outer face walls, said face walls being spaced a distance apart, so as to receive contactingly a door therebetween, edge walls connecting said opposed face walls, said edge walls being at right angles to each other and to said face walls, so said edge walls may contact adjacent edges of a door, said inner face wall having threaded stud means protruding perpendicularly therefrom to mount said support means thereon, said edge walls extending toward each other at least about ¼ inch past an imaginary plane at right angles to each said edge wall and passing through the center of said stud means.

2. In a security system kit for mounting to the inner face of a door to engage the floor to prevent the door being opened comprising in combination:

bracket means, support means mountable on said door by said bracket means, prop means pivotally mounted in said support means by locking system means, and floor contacting foot means pivotally mounted on said prop means, the improvement wherein said support means comprises base wall means for mounting to the inner face of a door, and said support means includes channel means extending upward from attachment means to said bracket means when said base wall means is mounted on a door, said channel means including paired spaced apart opposed channel walls having facing longitudinally extending grooves therein, said locking system means comprising slide means slidably mounted in said channels means, said slide means having side flanges slidably received in said grooves, said slide means mounting releasable locking means, said channel means further including receiving means for mating engagement of said locking means, extending longitudinally of said channel means.

3. In a security system kit for mounting to the inner face of a door to engage the floor to prevent the door being opened comprising in combination:

bracket means adapted to engage inner and outer faces of said door, support means mountable on said door by said bracket means, prop means pivotally mounted in said support means by locking system means, said locking system means being slidably mounted in said support means, and floor contacting foot means pivotally mounted on said prop means, the improvement comprising said prop means having a lower end pivotally mounting foot means, said foot means having floor contacting base means and paired opposed side walls, said foot means being pivotable between an upper position aligned with said prop means and a lower angled position from about 110° to about 120 °, downward and outward of said upper position, said prop lower end having a surface engaging a surface of said base means in said lower angled position and preventing further outward and downward rotation.

4. In a security system kit for mounting to the inner face of a door to engage the floor to prevent the door being opened comprising in combination:

bracket means, support means mountable on said door by said bracket means, prop means pivotally mounted in said support means by locking system means, and floor contacting foot means pivotally mounted on said prop means, the improvement comprising said bracket means having opposed spaced apart parallel inner and outer face walls, said face walls being spaced a distance apart, so as to receive contactingly a door therebetween, edge walls connecting said opposed face walls, said edge walls being at right angles to each other and to said face walls, so said edge walls may contact adjacent edges of a door, said inner face wall having attachment means mounted thereon to mount said support means thereon, said edge walls extending toward each other at least about ¼ inch past an imaginary plane at right angles to each said edge wall and passing through the center of said support means.

5. The structure as defined in claim 1, wherein said edge walls extend toward each other at least ⅜ inch past said imaginary planes.

6. The structure as defined in claim 5, wherein said inner face wall has four circular inner face wall apertures equidistant said threaded stud means, each inner face wall aperture being centered on an imaginary line passing through the center of said threaded stud means and at right angles to one said edge wall.

7. The structure as defined in claim 6, wherein said threaded stud means is central of said inner face wall.

8. The structure as defined in claim 4, wherein said support means comprises base wall means for mounting to the inner face of a door, and said support means includes channel means extending upward from attachment means to said bracket means when said base wall means is mounted on a door, said channel means including paired spaced apart opposed channel walls having facing longitudinally extending grooves therein, said locking system comprising slide means slidably mounted in said channels means, said slide means having side flanges slidably received in said grooves, said slide means mounting releasable locking means, said channel means further including receiving means for mating engagement of said locking means, extending longitudinally of said channel means.

9. The structure as defined in claim 8 wherein each said channel means walls has saw tooth surfaces extending longitudinally of said walls, facing away from said door when said support means is mounted thereon, and well means within said slide means has opposed inner and outer walls, said outer wall having an aperture, shaft means slidably mounted in said aperture, block means having saw tooth surface means mounted on said shaft means, spring means in said well means in contact with said block means and said outer wall urging said saw tooth surface means into mating engagement with said saw tooth surfaces of said channel walls, handle means attached to said shaft means, enabling disengagement of said block means.

10. The structure as defined in claim 8 wherein said channel means has an longitudinal array of equidistant apertures in said base wall means, and well means within said slide means has opposed inner and outer walls, said outer wall having an aperture, shaft means slidably mounted in said aperture, block means having prongs slidably received in apertures in said inner wall, spring means in said well means in contact with said block means and said outer wall urging said prongs through said inner wall to be received matingly in said array of equidistant apertures, handle means attached to said shaft means, enabling disengagement of said prongs from said array of apertures.

11. The structure as defined in claim 9, wherein said base wall means includes first lower base aperture means to receive said threaded stud means of said bracket means allowing said base wall means to be bolted to said bracket means, said base having two larger circular lower apertures equidistant from said first lower base aperture means, said larger apertures being aligned above and below said first lower base aperture means when said base wall means is mounted on said door, said larger base apertures containing alignment plugs which protrude matingly into two opposed apertures in said bracket inner face wall.

12. The structure as defined in claim 10, wherein said base wall means includes first lower base aperture to receive said threaded stud means of said bracket means allowing said base wall means to be bolted to said bracket means, said base having two larger circular lower apertures equidistant from said first lower base aperture means, said larger apertures being aligned above and below said first base aperture when said base wall means is mounted on said door, said larger base apertures containing alignment plugs which protrude matingly into two opposed apertures in said bracket inner face wall.

13. The structure as defined in claim 8, comprising said prop means having a lower end pivotally mounting foot means, said foot means having floor contacting base means and paired opposed side walls, said foot means being pivotable between an upper position aligned with said prop means and a lower angled position from about 110° to about 120° downward and outward of said upper position, said prop lower end having a surface engaging a surface of said base means in said lower angled position and preventing further outward and downward rotation.

14. The structure as defined in claim 13, wherein said locking system means has pivot means, to pivotally mount prop means at an upper end, said upper end being pivotable between a first upper position angled from about 20° to about 30° outward and downward of said support means and a second position adjacent said support means, said slide means having a surface which engages a surface of said upper end of said prop in said first position preventing further upward and outward rotation.

15. The structure as defined in claim 14, wherein said lower angled position of said foot means is about 115° downward and outward of said upper position, said first upper position is angled about 25° outward and downward of said support means, and said base means has a floor contacting surface of frictional material.

16. The structure as defined in claim 2 wherein each said channel means walls has saw tooth surfaces extending longitudinally of said walls, facing away from said door when said support means is mounted thereon, and well means within said slide means has opposed inner and outer walls, said outer wall having an aperture, shaft means slidably mounted in said aperture, block means having saw tooth surface means mounted on said shaft means, spring means in said well means in contact with said block means and said outer wall urging said saw tooth surface means into mating engagement with said saw tooth surfaces of said channel walls, handle means attached to said shaft means, enabling disengagement of said block means.

17. The structure as defined in claim 2 wherein said channel means has an longitudinal array of equidistant apertures in said base wall means, and well means within said slide means has opposed inner and outer walls, said outer wall having an aperture, shaft means slidably mounted in said aperture, block means having prongs slidably received in apertures in said inner wall, spring means in said well means in contact with said block means and said outer wall urging said prongs through said inner wall to be received matingly in said array of equidistant apertures, handle means attached to said shaft means, enabling disengagement of said prongs from said array of apertures.

18. The structure as defined in claim 2, wherein said prop means comprises a lower end pivotally mounting foot means, said foot means having floor contacting base means and paired opposed side walls, said foot means being pivotable between an upper position aligned with said prop means and a lower angled position from about 110° to 120°, downward and outward of said upper position, said prop lower end having a surface engaging a surface of said base means in said lower angled position and preventing further outward and downward rotation, said base wall means having a floor contacting surface of frictional material.

19. The structure as defined in claim 18, wherein said locking system means has pivot means, to pivotally mount prop means at an upper end, said upper end being pivotable between a first upper position angled from about 20° to about 30° outward and downward of said support means and a second position adjacent said support means, said slide means having a surface which engages a surface of said upper end of said prop in said first position preventing further upward and outward rotation.

20. The structure as defined in claim 3, wherein said locking system means has pivot means, to pivotally mount prop means at an upper end, said upper end being pivotable between a first upper position angled from about 20° to about 30° outward and downward of said support means and a second position adjacent said support means, said locking system means having a surface which engages a surface of said upper end of said prop in said first position preventing further upward and outward rotation.

21. The structure as defined in claim 20, wherein said lower angled position of said foot means is about 115° downward and outward of said upper position, said first upper position is angled about 25° outward and downward of said support means, and said base means has a floor contacting surface of frictional material.

* * * * *